US008496100B2

(12) United States Patent
Fergusson

(10) Patent No.: US 8,496,100 B2
(45) Date of Patent: Jul. 30, 2013

(54) COIN PROCESSING DEVICE WITH TEMPORARY COIN WITHHOLDING MECHANISM

(75) Inventor: Lachlan Edward Fergusson, Sydney (AU)

(73) Assignee: Nippon Conlux Co., Ltd., Sakado-Shi (JP)

( * ) Notice: Subject to any disclaimer, the term of this patent is extended or adjusted under 35 U.S.C. 154(b) by 0 days.

(21) Appl. No.: 13/704,096

(22) PCT Filed: Dec. 20, 2010

(86) PCT No.: PCT/JP2010/072853
§ 371 (c)(1),
(2), (4) Date: Dec. 13, 2012

(87) PCT Pub. No.: WO2012/014341
PCT Pub. Date: Feb. 2, 2012

(65) Prior Publication Data

US 2013/0090048 A1 Apr. 11, 2013

(30) Foreign Application Priority Data

Jul. 27, 2010 (JP) ..... 2010-168369

(51) Int. Cl.
*G07F 1/04* (2006.01)
*G07D 3/14* (2006.01)

(52) U.S. Cl.
USPC ..... 194/344; 194/345; 194/346

(58) Field of Classification Search
USPC ..... 194/229, 293–297, 344–346
See application file for complete search history.

(56) References Cited

U.S. PATENT DOCUMENTS

2002/0050438 A1* 5/2002 Faes et al. ..... 194/207

FOREIGN PATENT DOCUMENTS

| | | |
|---|---|---|
| JP | 2002 190049 | 7/2002 |
| JP | 2003 296787 | 10/2003 |
| JP | 2009 238184 | 10/2009 |

OTHER PUBLICATIONS

International Search Report Issued Feb. 1, 2011 in PCT/JP10/072853 Filed Dec. 20, 2010.

* cited by examiner

*Primary Examiner* — Jeffrey Shapiro
(74) *Attorney, Agent, or Firm* — Oblon, Spivak, McClelland, Maier & Neustadt, L.L.P.

(57) ABSTRACT

A coin processing device includes a temporary coin-withholding mechanism for driving coin withholding levers using a single driving device. The temporary coin-withholding mechanism includes a single driving mechanism, a first coin withholding lever for withholding/releasing a coin guided by a first coin sorting route, a second coin withholding lever for withholding/releasing a coin guided by a second coin sorting route, and a link mechanism including detecting whether a coin is withheld in the first coin sorting route. When the retention is detected, the first lever is shifted from the withholding position to the release position to allow the driving mechanism to drive only the first coin lever without driving the second coin lever. When the retention is not detected, the second lever is shifted from the withholding position to the release position to allow the driving mechanism to drive the second coin withholding lever.

3 Claims, 13 Drawing Sheets

COIN PROCESSING DEVICE WITH TEMPORARY COIN WITHHOLDING MECHANISM

TECHNICAL FIELD

The present invention relates to a coin processing device to be mounted on an apparatus such as an automatic vending machine, a money changing machine, a fare adjustment machine, a ticket vending machine, or service machine (hereinafter, referred to as an "automatic vending machine or the like"). More particularly, the present invention relates to a temporary coin withholding mechanism installed in such a coin processing device to temporary withhold a coin inserted in the coin processing device.

BACKGROUND ART

In the inside of an automatic vending machine or the like, there is a coin processing device that determines whether inserted coins are genuine or not, sorts and stores the inserted coins considered as genuine coins, and pays out the sorted and stored coins in accordance with the amount of change or the like. FIG. 10 is a diagram that schematically illustrates such a coin processing device.

A coin processing device 1 typically includes: a coin sorter 2 that determines whether inserted coins are genuine or not and sorts the inserted coins according to denomination; a coin storage unit 3 that stores the inserted coins sorted by the coin sorter 2 for every denomination; and a coin payout unit 4 for selecting and paying out coins according to the amount of change or the like from the coin storage unit 3.

In many coin processing devices 1, presently, the coin sorter 2 has a temporary coin withholding mechanism that temporary withholds the inserted coins before storing the inserted coins in a coin storage unit 3.

In the case of a coin processing device 1 without the temporary coin withholding mechanism, when a coin inserted in the coin processing device 1 is determined as a genuine coin by the coin sorter 2, the inserted coin is directly stored in the coin storage unit 3. Therefore, when a coin is inserted into an automatic vending machine or the like equipped with the coin processing device 1 and a coin return lever or the like is then operated to return the coin without purchasing a product, the inserted coin itself is not returned. Instead, a coin to be paid out is any of coins stored in the coin storage unit 3 and equal in amount to the inserted coin. In such a coin processing device 1, if a sophisticated counterfeit coin that is realistic enough to be deemed a genuine coin is inserted and a coin return lever or the like is then operated to return the coin without purchasing a product, any genuine coin stored in the coin storage unit 3 is paid out instead of the inserted counterfeit coin itself. In other words, the so-called coin-switching phenomenon occurs.

On the other hand, a coin processing device 1 equipped with a temporary coin withholding mechanism, inserted coins are determined as genuine coins by the coin sorter 2 and then temporally withheld in the temporary coin withholding mechanism before being stored in the coin storage unit 3. Subsequently, when a coin is inserted into the automatic vending machine or the lie equipped with the coin processing device and a coin return lever or the like is then operated to return the coin without purchasing a product, a coin temporary withheld by the temporary coin withholding mechanism, which is just the inserted coin itself, can be returned. Therefore, even if a sophisticated counterfeit coin that is realistic enough to be deemed a genuine coin is inserted and a coin return lever or the like is then operated to return the coin without purchasing a product, the coin processing device 1 having the temporary coin withholding mechanism will not cause any coin switching phenomenon.

In Patent Document 1 (JP 2002-63628 A), a temporary coin withholding mechanism installed in a conventional coin processing device is disclosed. Hereinafter, with reference to FIGS. 11 to 14, the temporary coin withholding mechanism installed in the conventional coin processing device will be described.

FIG. 11 is a schematic front view of a coin sorter 2 of the conventional coin processing device 1. The coin sorter 2 is configured to sort genuine coins and false coins of four different types, A-type coins (500-yen coins), B-type coins (10-yen coins), C-type coins (100-yen coins), and D-coins (50-yen coins). The types of coins inserted from an insertion opening 21 of the coin sorter 2 are determined by a coin determination means placed on a coin discrimination route 22. Depending on the types, a genuine/false coin distributing lever 24 and a plurality of denomination distributing lever 25, which are placed on the downstream of the coin discrimination route 22, sort the coins into a false coin ejection route and coin sorting routes provided for only guiding coins of the respective denominations. In the coin sorter 2, a temporary coin withholding mechanism 5 is placed on each of the downstream end of a A-type coin sorting route 261 for guiding A-type coins (500-yen coins) and the downstream end of a C-type coin sorting route 262 for guiding C-type coins (100-yen coins). In most cases, the conventional coin processing device 1 includes the temporary coin withholding mechanisms 5 respectively placed on two coin sorting routes of comparatively high-denomination coins.

FIG. 12 is a schematic front view of the coin sorter of the conventional coin processing device, where (a) illustrates the state in which coins are temporary withheld in the A-type coin sorting route 261 and (b) illustrates the state in which coins are temporary withheld in the C-type coin sorting route 262. In this example, the A-type coin sorting route 261 can temporary withhold three coins and the C-type coin sorting route 262 can temporary withhold four coins in the C-type coin-sorting route 262.

FIG. 13 is a cross-sectional diagram of the principal part of the conventional temporary coin withholding mechanism 5, which is placed on the downstream end of the A-type coin-sorting route 261, and the periphery thereof, where (a) illustrates the state in which a coin withholding lever 71 temporary withholds coins and (b) illustrates the state in which the coin withholding lever 71 releases coins. The temporary coin withholding mechanism 5 includes a driving means (not shown), such as a solenoid, and a coin withholding lever 71 having a lower protrusion 71*a* and an upper protrusion 71*b*. Then, the coin withholding lever 71 is rotated about its lateral axis 71*c* as a pivot point to cause the lower protrusion 71*a* and the upper protrusion 71*b* of the lever 71 protrude into the coin sorting route 261 or retract from the coin sorting route 261 through a hole 261*a* formed in the lateral side of the A-type coin sorting route 261.

In the initial state, as illustrated in FIG. 13(*a*), the coin withholding lever 71 is biased counterclockwise around its axis 71*c* as a pivot point and stopped. As a result, the lower protrusion 71*b* protrudes into the A-type coin sorting route 261 and the upper protrusion 71*b* thereof is retracted from the A-type coin sorting route 261 (withholding position of the coin withholding lever). In this initial state, a coin guided in the coin sorting route 261 is blocked by the lower protrusion 71*a* of the coin withholding lever 71, which protrudes into the A-type coin sorting route 261, and then temporary withheld therein. A subsequent coin guided in the A-type coin sorting route 261 is also blocked by the coin previously withheld, and then temporary withheld therein. In this way, a plurality of coins is temporary withheld in the A-type coin sorting route 261 one after the other. Here, the number of coins which can be temporary withheld depends on the size of the coins and the length of the coin sorting route 261.

If the coin withholding lever 71 is rotated clockwise around its axis 71*c* as a pivot point by the driving means such as a solenoid while a plurality of coins is temporary withheld in the A-type coin storing route 261, as illustrated in FIG. 13(*b*), the lower protrusion 71*a* is retracted from the A-type coin sorting route 261 and the upper protrusion 71*b* protrudes into the A-type coin sorting route 261 (release position of the coin withholding lever). As a consequence, the coin which has been blocked by the lower protrusion 71*a* of the coin withholding lever 71 is unblocked and released to the downstream. Then, the coin immediately after the coin which has been blocked by the lower protrusion 71*a* of the coin withholding lever 71 is blocked by the upper protrusion 7*b* protruded into the coin sorting route 261. Therefore, the coins are remained in being temporary withheld in the A-type coin sorting route. Subsequently, if the coin withholding lever 71 is returned to the initial state (withholding position of the coin withholding lever) illustrated in FIG. 13(*a*), the upper protrusion 71*b* is retracted from the A-type coin sorting route 261, and the lower protrusion 71*a* protrudes into the A-type coin sorting route 261. Consequently, the coin, which has been blocked by the upper protrusion 71*b*, is unblocked and falls down, and is then blocked by the lower protrusion 71*a* protruded into the A-type coin sorting route 261 and temporary withheld therein. By repeating such an operation, coins can be intermittently released one by one.

A temporary coin withholding mechanism provided on the downstream end of the C-type coin sorting route 262 is basically the same temporary coin withholding mechanism as one provided on the downstream end of the A-type coin sorting route except of differences in the shape of the lower protrusion of the coin withholding lever and the like.

FIG. 14 is a schematic cross-sectional diagram illustrating coin sorting levers 281 and 282 placed on the downstream the temporary coin withholding mechanism 5, where (a) illustrates the state in which a coin is sorted into a coin return outlet, (b) illustrates the state in which a coin is sorted into a coin tube of a coin storage unit, (c) illustrates the state where a coin is sorted into a cashbox. As illustrated in this figure, a coin released from the temporary coin withholding mechanism 5 is sorted into any one of the coin return outlet, the coin tube of the coin storage unit, and the cashbox of the coin storage unit by two coin sorting levers 281 and 282 provided on the downstream side of the temporary coin withholding mechanism.

The conventional temporary coin withholding mechanism described above is configured such that one driving means such as a solenoid is provided for each coin withholding lever and the coin withholding levers are independently driven by different driving means. In contrast, Patent Document 2 (JP 2009-238184 A) discloses a temporary coin withholding mechanism that drives two coin withholding levers by a single solenoid.

CITATION LIST

Patent Literatures

Patent Document 1: JP 2002-63628 A

Patent Document 2: JP 2009-238184 A

SUMMARY OF INVENTION

Technical Problem

The conventional temporary coin-withholding mechanism requires one driving means such as a solenoid for each coin withholding lever, so that there is a problem of its increased production cost. To cope with such a production cost problem, Patent Document 2 (JP 2009-238184 A) discloses an escrow device (temporary coin-withholding mechanism) that employs a single solenoid to drive two escrow levers (coin withholding levers). However, in this device in the initial state, one of two escrow levers (coin withholding levers) blocks coins by its upper protrusion. Thus, there is a problem in that the number of coins to be temporary withheld in one of coin sorting routes decreases. In this device, furthermore, two different types of coins are alternately released, so that there is a problem in that controlling a coin sorting lever located on the downstream of the temporary coin-withholding mechanism is difficult in the case of sorting two different coins into different destinations. Besides, in this device, there is a problem in that the number of escrow levers (coin withholding levers) is limited to two. If there are three or more escrow levers, these levers cannot be driven by a single solenoid.

An object of the present invention is to solve the aforementioned problems. Specifically, an object of the present invention is to provide a coin processing device having a temporary coin-withholding mechanism capable of lowering a production cost by driving a plurality of coin withholding lever with a single driving means. Furthermore, an object of the present invention is to provide a coin processing device having a temporary coin-withholding mechanism that does not reduce the number of coins to be temporary withheld in coin sorting routes even if a plurality of coin withholding levers is driven by a single driving means. Furthermore, an object of the present invention is to provide a coin processing device having a temporary coin-withholding mechanism by which a coin sorting lever located on the downstream of the temporary coin-withholding mechanism can be easy controlled even if a plurality of coin withholding levers is driven by a single driving means. Furthermore, the present invention intends to provide a coin processing device having a temporary coin-withholding mechanism by which three or more coin withholding levers can be easily driven by a single driving means.

Solution to Problem

In order to attain the above objects, a coin processing device according to a first aspect includes a temporary coin-withholding mechanism. The mechanism includes: a single driving means; a first coin withholding lever capable of taking a withholding position for withholding a first coin guided by a first coin sorting route at a predetermined position and a release position for releasing the first coin; a second coin withholding lever capable of taking a withholding position for withholding a second coin guided by a second coin sorting route at a predetermined position and a release position for releasing the second coin; and a link means having a function of detecting whether the first coin is withheld in the first coin sorting route. The link means is configured that, when the retention is detected, the link means shifts the first coin withholding lever from the withholding position to the release position to make the driving mean drive only the first coin withholding lever without driving the second coin withholding lever; and when the retention is not detected, the link means shifts the second coin withholding lever from the withholding position to the release position to make the driving means drive the second withholding lever.

A coin processing device according to a second aspect includes a temporary coin-withholding mechanism. The mechanism includes: a single driving means having a operation part and capable of switching the operation part between a withholding-operation position and a driving-operation position;

a first coin withholding lever capable of taking a withholding position for withholding a first coin guided by a first coin sorting route at a predetermined position and a release position for releasing the first coin; a second coin withholding lever capable of taking a withholding position for withholding a second coin guided by a second coin sorting route at a predetermined position and a release position for releasing the second coin; a first link member driven by the operation part of the driving means, where the first link member takes a withholding position when the operation part takes the withholding-operation position, and takes a release position when the operation part takes the driving-operation position; a second link member capable of taking a withholding position and a release position; a coin detection/link member having a function of detecting whether the first coin is withheld in the first coin sorting route, and capable of taking, in response to a result of the detection, an engagement position for engagement with the first link member and the second link member and a non-engagement position at which the engagement with at least one of the first link member and the second link member is canceled. The coin detection/link member is configured that, when the retention is not detected, the coin detection/link member takes the engagement position; when the first link member takes the withholding position, the coin detection/link member makes the second link member take the withholding position, and when the first link member is switched to the release position, the coin detection/link member makes the second link member take the release position; and, when the retention is detected, the coin detection/link member takes the non-engagement position to make the second link take the withholding position regardless of the position of the first link member. The first coin withholding layer is engaged with the first link member, takes the withholding position when the first link member is located at the withholding position, and is switched to the release position by the first link member when the first link member is switched to the release position. The second coin withholding lever is engaged with the second link member, takes the withholding position when the second link member is located at the withholding position, and is switched to the release position by the second link member when the second link member is switched to the release position.

A coin processing device according to a third aspect is the coin processing device of the second aspect, where the coin detection/link member includes: an engagement protrusion rotatably engaging with the second link member and detachably engaging with a U-shaped groove formed in the first link member; and a coin detection protrusion to be retracted from the first coin sorting route by the first coin when the first coin is withheld in the first coin sorting route and to be protruded into the first coin sorting route when the first coin is not withheld in the first coin sorting route. The coin detection/link member is configured that, when the first coin is not withheld in the first coin sorting route, the engagement protrusion of the coin detection/link member is engaged with the U-shaped groove of the first link member; and when the first coin is withheld in the first coin sorting route, the coin detection protrusion is retracted from the first coin sorting route to allow the coin detection/link member to rotate about the first link member, and the rotation of the coin detection/link member cancels the engagement of the engagement protrusion of the coin detection/link member with the u-shaped groove of the first link member.

Advantageous Effects of Invention

According to the present invention, a plurality of coin withholding lever is configured to be driven by a single driving means. Thus, the production cost can be reduced. According to the present invention, furthermore, coins temporary withheld in one coin sorting route are successively released, while coins temporary withheld in different coin sorting routes are not alternately released. Thus, the coin sorting levers located on the downstream of the temporary coin-withholding mechanism can be easily controlled. According to the present invention, furthermore, a method, which is used for temporary withholding a plurality of coins, itself is the same as one conventionally used in the art as described above. In spite of driving a plurality of coin withholding lever by a single driving means, the number of coins temporary withheld in the coin sorting route does not decrease. According to the present invention, therefore, three or more coin withholding levers can be easily driven by a single driving means.

DESCRIPTION OF EMBODIMENTS

Hereinafter, one embodiment of the present invention will be described with reference to the drawings.

Figure 1:
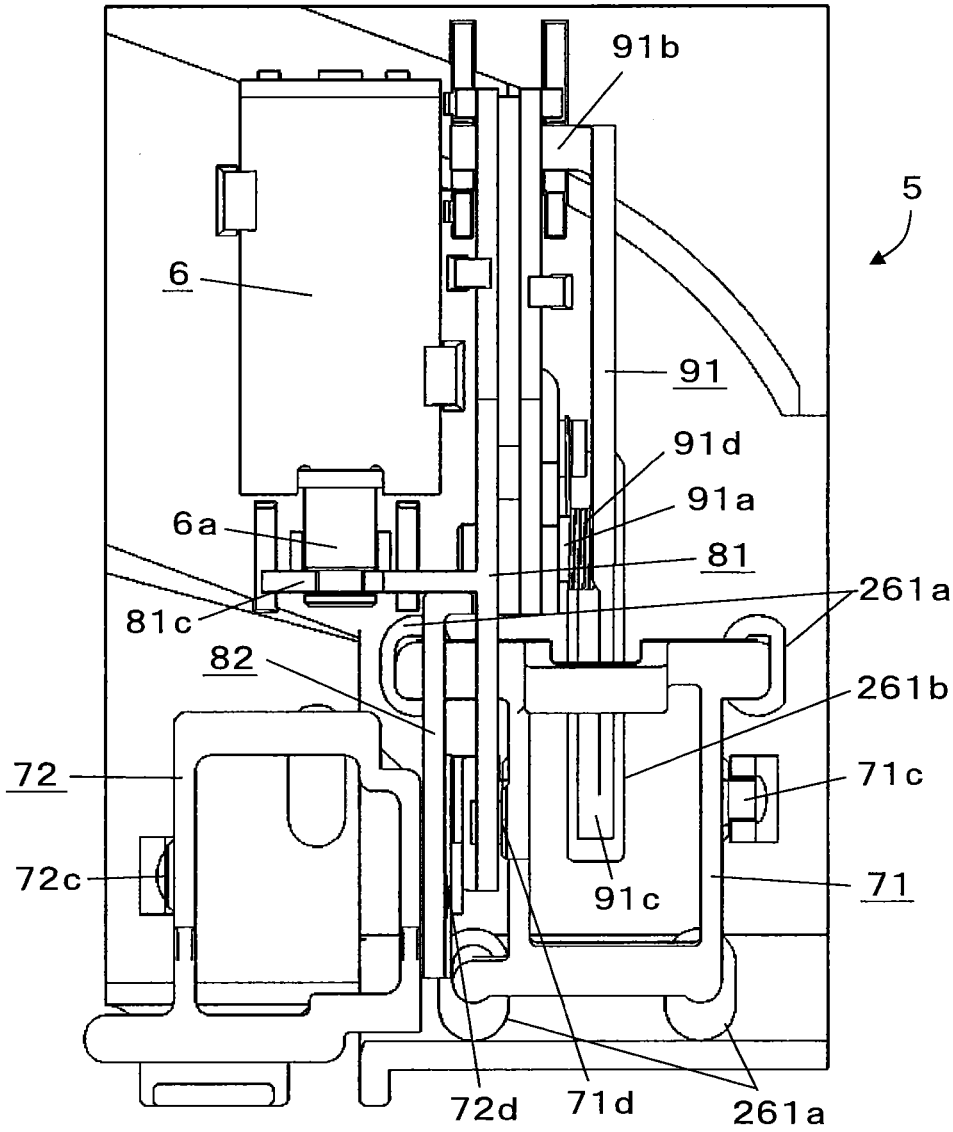
FIG. 1 is a diagram illustrating the initial state of a temporary coin-withholding mechanism installed in a coin processing device according to the embodiment of the present invention, viewing from the backside of the coin processing apparatus.
Figure 2:
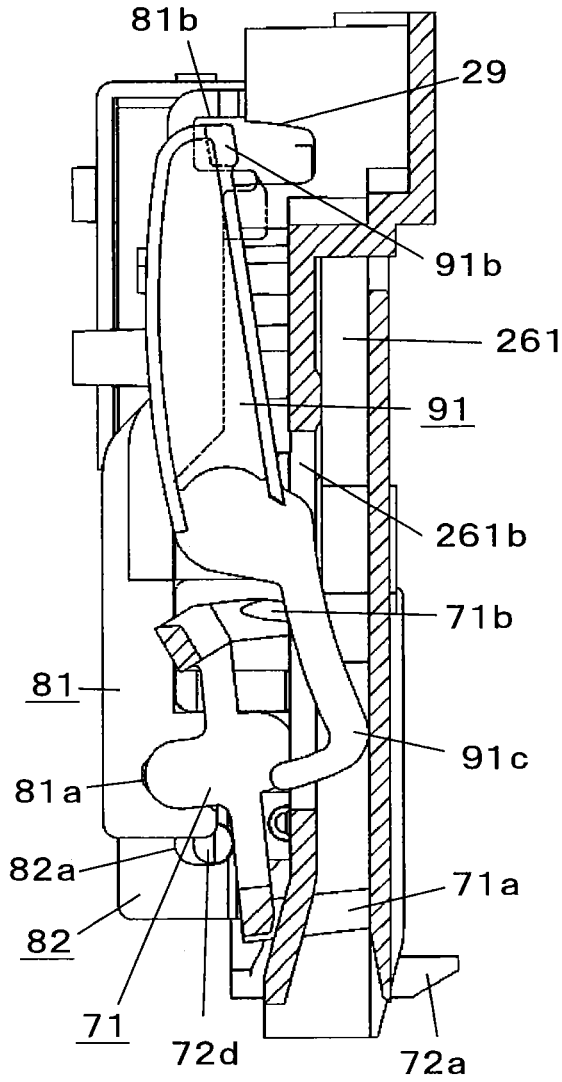
FIG. 2 is a longitudinal cross-sectional view of the temporary coin-withholding mechanism of the coin processing device according to the embodiment of the present invention.
Figure 3:
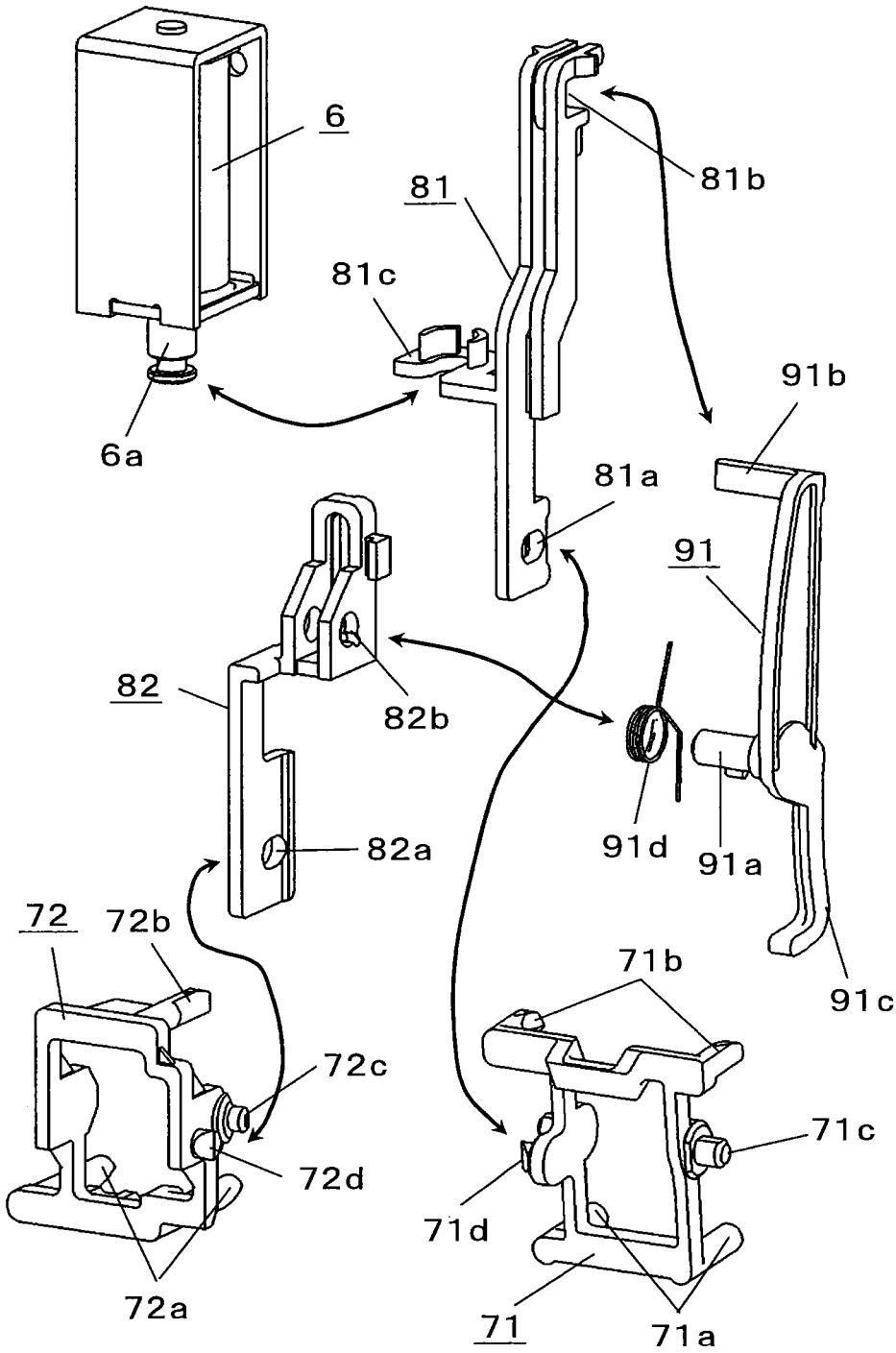
FIG. 3 is an exploded perspective view of the structural components of the temporary coin-withholding mechanism of the coin processing device according to the embodiment of the present invention.

FIG. 1 is a diagram illustrating the initial state of a temporary coin-withholding mechanism installed in a coin processing device, viewing from the backside of the coin processing apparatus. FIG. 2 is a longitudinal cross-sectional view of the temporary coin-withholding mechanism, and FIG. 3 is an exploded perspective view of the structural components of the temporary coin-withholding mechanism. The coin processing device according to the embodiment has a similar configuration as that of the aforementioned conventional coin processing device, except for a mechanism for driving coin withholding levers. In the present embodiment, therefore, the same reference numerals are assigned to the same structural components as those of the aforementioned conventional coin processing device, and their detailed descriptions will be omitted. In the present embodiment, furthermore, a first coin sorting route corresponds to the aforementioned A-type coin sorting route 261 and a second coin sorting route corresponds to the aforementioned C-type coin sorting route 262.

The temporary coin-withholding mechanism 5 of the coin processing device according to the present embodiment includes a first coin withholding lever 71 for temporary withholding a coin guided by a first coin sorting route 261; a second coin withholding lever 72 for temporary withholding a coin guided by a second coin sorting route 262; a single solenoid 6 provided as a driving means; and a first link member 81 and a second link member 82, which are provided as means for linking the driving means to the coin withholding levers 71 and 72; and a coin detection/link member 91.

Figure 11:
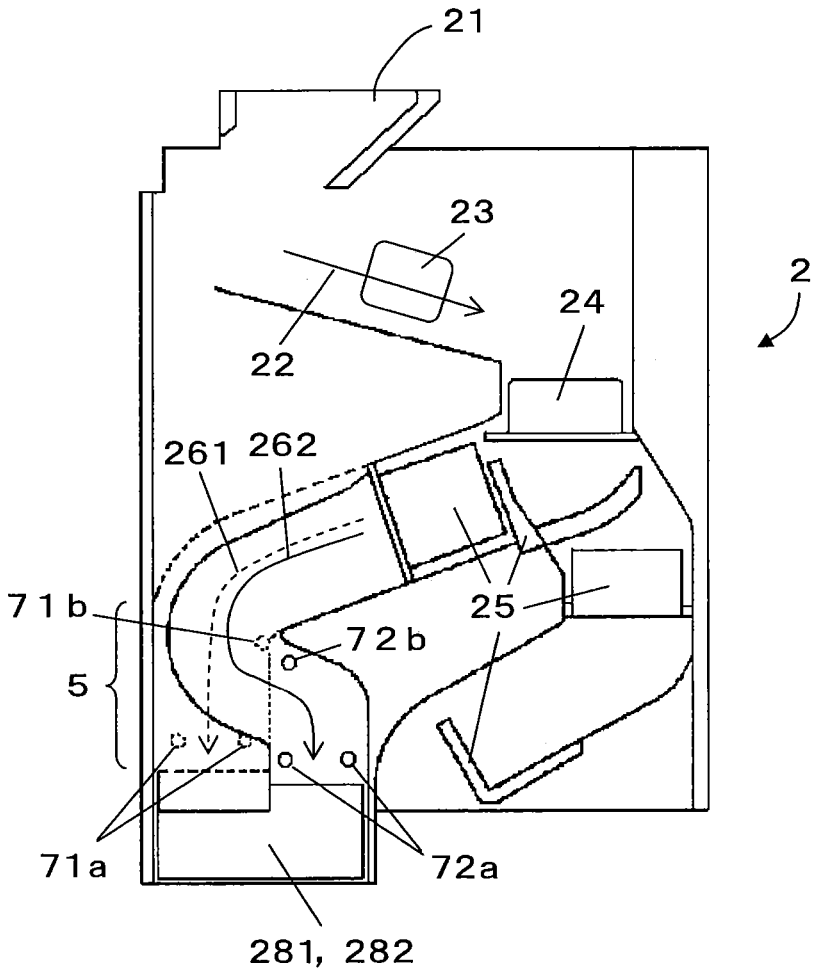
FIG. 11 is a schematic front view of a coin sorter installed in the conventional coin processing device.
Figure 12:
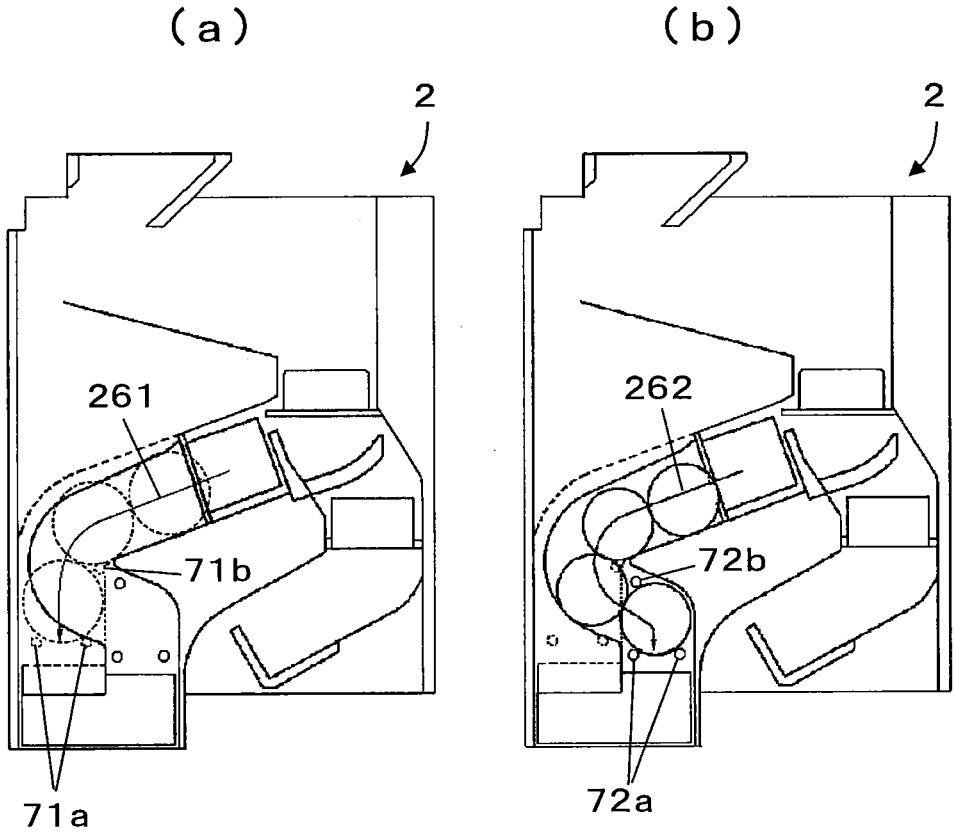
FIG. 12 is a schematic front view of a coin sorter installed in the conventional coin processing device, where (a) illustrates the state in which coins are temporary withheld in the A-type coin sorting route and (b) illustrates the state in which coins are temporary withheld in the C-type coin sorting route.
Figure 13:
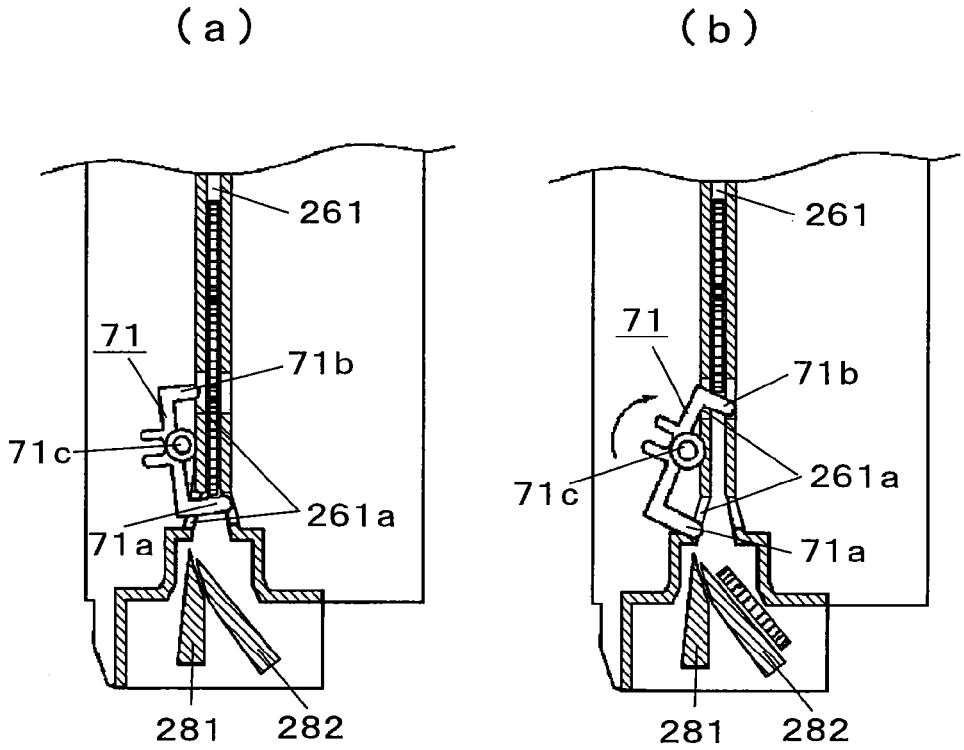
FIG. 13 is a cross-sectional diagram of the principal part of the conventional temporary coin-withholding mechanism, which is placed on the downstream end of the A-type coin-sorting route, and the periphery thereof, where (a) illustrates the state in which a coin withholding lever temporary withholds coins and (b) illustrates the state in which the coin withholding lever releases coins.
Figure 14:
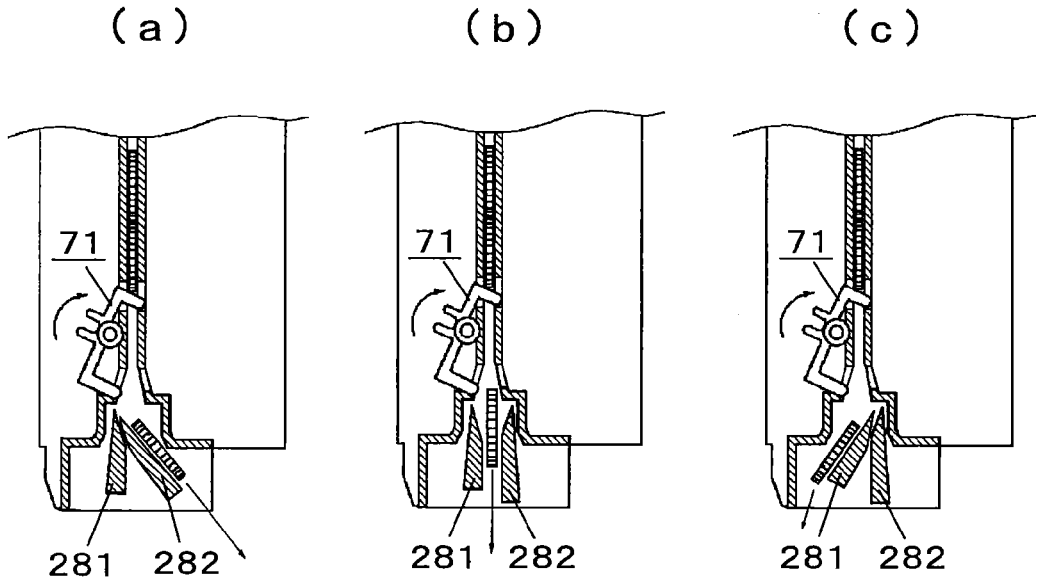
FIG. 14 is a schematic cross-sectional diagram illustrating the operation of the coin sorting levers placed on the downstream the temporary coin-withholding mechanism, where (a) illustrates the state in which a coin is sorted into a coin return outlet, (b) illustrates the state in which a coin is sorted into a coin tube of a coin storage unit, (c) illustrates the state where a coin is sorted into a cashbox.

The first coin withholding lever 71 is in the form of a substantially square shape as is specifically shown in FIG. 3, and includes two lower protrusions 71*a* in the form of a substantially cylindrical shape and two upper protrusions 71*b* in the form of a substantially cylindrical shape. The first coin withholding lever 71 is attached to the backside of a lower end portion of the first coin sorting route 261 (see FIG. 11) while being rotatable around axes 71*c* as a pivot point on the opposite lateral sides of the lever 71. In the initial state, a lower protrusion 71*a* of the lever 71 protrudes into the first sorting route 261 and an upper protrusion 71*b* thereof is retracted from the first coin sorting route 261 (the withholding position of the first coin withholding lever). In addition, the first coin withholding lever 71 includes a passive protrusion 71*d* for receiving transmission of power of the link means. The passive protrusion 71*d* is engaged in a hole 81*a* formed near the lower end portion of a first link member 81 described later. If the passive protrusion 71*d* is moved upward from the initial state by an upward force applied from the first link member 81, the first coin withholding lever 71 is rotated around the axes 71*c* as a pivot point. Consequently the lower protrusion 71*a* of the lever 71 is retracted from the first coin sorting route 261, and the upper protrusion 71*b* thereof protrudes into the first coin sorting route 261 (the release position of the first coin withholding lever).

Like the first coin withholding lever 71, the second coin withholding lever 72 is also in the form of a substantially square shape and includes two substantially cylindrical lower protrusions 72*a* and one substantially cylindrical upper protrusion 72*b*. The second coin withholding lever 72 is attached to the backside of a lower end portion of the second coin sorting route 262 (see FIG. 11) while being rotatable around axes 72*c* as a pivot point on the opposite lateral sides of the lever 72. In the initial state, a lower protrusion 72*a* of the lever 72 protrudes into the second coin sorting route 262 and an upper protrusion 72*b* thereof is retracted from the second coin sorting route 262 (withholding position of the second coin withholding lever). Like the first coin withholding lever 71, the second coin withholding lever 72 includes a passive protrusion 72*d* for receiving transmission of power of the link means. The passive protrusion 72*d* is engaged in a hole 82*a* formed near the lower end portion of a second link member 82 described later. If the passive protrusion 72*d* is moved upward from the initial state by an upward force applied from the second link member 82, the second coin withholding lever 72 is rotated around the axes 72*c* as a pivot point. Consequently the lower protrusion 72*a* of the lever 72 is retracted from the second coin sorting route 262, and the upper protrusion 72*b* thereof protrudes into the second coin sorting route 262 (the release position of the second coin withholding lever).

A plunger 6*a* of the solenoid 6 provided as a driving means is downwardly biased by a spring (not shown) in the initial state (the withholding-operation position of the driving means). Upon driving the solenoid 6, the plunger 6*a* is pulled upward from the initial state (the driving-operation position of the driving means).

The first link member 81 constituting the link means has an elongated shape. The first link member 81 includes: a connection part 81*c* near the center portion thereof on which the plunger 6*a* of the solenoid 6 is fixed; and a hole 81*a* near the lower end portion thereof in which the passive protrusion 71*b* of the first coin withholding lever 71 is engaged. Furthermore, the first link member 81 includes a U-shaped groove 81*b* formed near the upper end portion thereof. In the U-shaped groove 81*b*, an engagement protrusion 91*b* provided near the upper end portion of a coin detection/link member 91 described later is detachably engaged. The first link member 81 moves up and down in concert with movement of the plunger 6*a* of the solenoid 6. If the solenoid 6 is driven to pull the plunger 6*a* up (the driving-operation position of the driving means) from the initial state (the withholding-operation position of the driving means), the first link member 81 fixed on the plunger 6*a* also moves upward (the release position of the first link member) from the initial state (the withholding position of the first link member) in concert therewith. Simultaneously, the passive protrusion 71*d* of the first coin withholding lever 71 being engaged with the hole 81*a* of the upward-moving first link member 81 is also shifted upward from the initial state. Consequently, the first coin withholding lever 71 is rotated around the axes 71*c* as a pivot point to make the lower protrusion 71*a* of the lever 71 retract from the first coin sorting route 261 and to make the upper protrusion 71*b* thereof protrude into the first coin sorting route 261 (the release position of the first coin withholding lever). Furthermore, if the U-shaped groove 81*b* of the first link member 81 is engaged with the engagement protrusion 91*b* of the coin detection/link member 91, the coin detection/link member 91 also moves upward in concert with the upward movement of the first link member 91. On the other hand, if the engagement between the U-shaped groove 81*b* of the first link member 81 and the engagement protrusion 91*b* of the coin detection/link member 91 is canceled, the power of the first link member 81 is not transmitted to the coin detection/link member 91. Thus, the coin detection/link member 91 remains at the position of the initial state.

The second link member 82 constituting the link means has an elongated shape. The second link member 82 includes a hole 82*a* formed near the lower end portion thereof, where the passive protrusion 72*d* of the second coin withholding lever 72 is engaged with the hole 82*a*. The second link member 82 also includes a hole 82*b* formed near the upper end portion thereof, where the axis 91*a* formed near the center portion of a coin detection/link member 91 described later is rotatably engaged with the hole 82*b*. In the second link member 82, the hole 82*b* of the upper end portion is engaged with the axis 91*a* of the coin detection/link member 91. Therefore, if the coin detection/link member 91 moves upward from the initial state (the withholding position of the second link member), the second link member 82 is also shifted in concert with the movement thereof (the release position of the second link member). If the second link member 82 moves upward (the release position of the second link member) from the initial state (the withholding position of the second link member), the passive protrusion 72*d* of the second coin withholding lever 72 being engaged with the hole 82*a* near the lower end portion of the upward-moving second link member 82 is also shifted upward. Consequently, the second coin withholding lever 72 is rotated around the axes 72*c* as a pivot point to make the lower protrusion 72*a* of the lever 72 retract from the second coin sorting route 262 and to make the upper protrusion 72*b* thereof protrude into the second coin sorting route 262 (the release position of the second coin withholding lever).

The coin detection/link member 91 constituting the link means has an elongated shape. The coin detection/link member 91 includes: an axis 91*a* provided near the center portion thereof and rotatably engaged with the hole 82*b* formed near the upper end portion of the second link member 82; and an engagement protrusion 91*b* provided near the upper end portion thereof and detachably engaged with a U-shaped groove 81*b* formed near the upper end portion of the first link member 81. A coin detection protrusion 91C is provided near the lower end portion of the coin detection/link member 91, and can be appeared on the first coin storing route 261 therefrom and disappeared freely through a hole 261*b* formed in the first coin storing route 261. A spring 91*d* is arranged between the axis 91*a* of the coin detection/link member 91 and the hole 82*b* formed near the upper end portion of the second link member 82. In the state that there is no coin to be temporary withheld in the first coin sorting route 261, the spring 91*d* biases such that the coin detection protrusion 91*c* near the lower end portion of the coin detection/link member 91 can protrude into the first coin sorting route 261 and the engagement protrusion 91*b* of the coin detection/link member 91 can be engaged with the U-shaped groove 81*b* of the first link member 81. Therefore, in the state that there is no coin to be temporary withheld in the first coin sorting route 261, the engagement protrusion 91*b* of the coin detection/link member 91 and the U-shaped groove 81*b* of the first link member 81 come into engagement with each other (the engagement position of the coin detection/link member). In the state that there is a coin temporary withheld in the first coin sorting route 261, the coin detection protrusion 91*c* is pushed by the coin temporary withheld, and brought into a state of being retracted from the first coin sorting route 261. The engagement protrusion 91*b* is then brought into a state of being detached from the U-shaped groove 81*b* of the first link member 81 as a result of rotating around the axis 91*a* as a pivot point of the coin detection/link member 91. Therefore, in the state that there is a coin temporary withheld in the first coin sorting route 261, the engagement between the engagement protrusion 91*b* of the coin detection/link member 91 and the U-shaped groove 81*b* of the first link member 81 is brought into the state of being canceled (the non-engagement position of the coin detection/link member).

Figure 4:
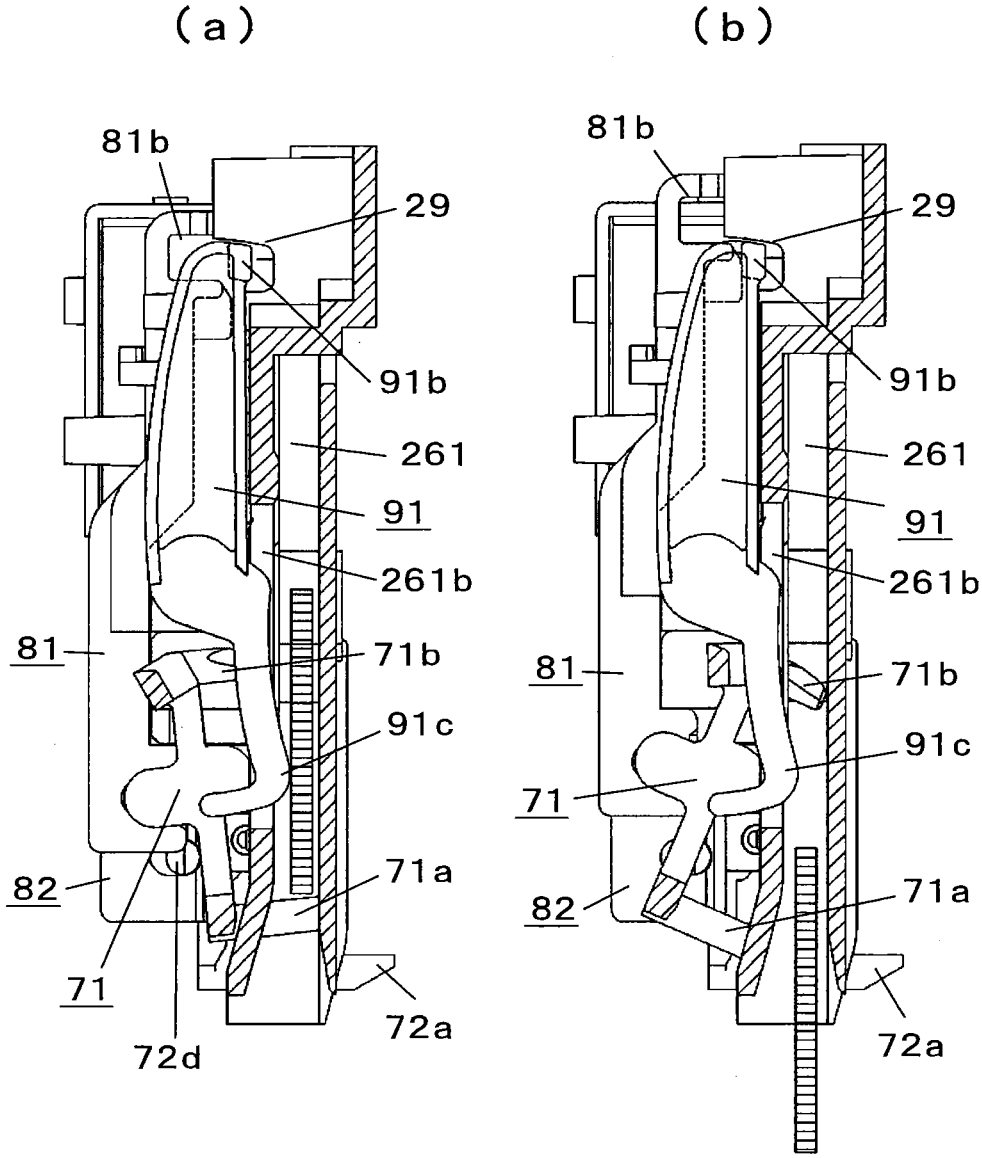
FIG. 4 is a cross-sectional view of the first coin sorting route of the temporary coin withholding mechanism of the coin processing device according to the embodiment of the present invention in the state that there is a coin temporary withheld in the first coin sorting route, where (a) illustrates the initial state and (b) illustrates the state in which the solenoid is driven.
Figure 5:
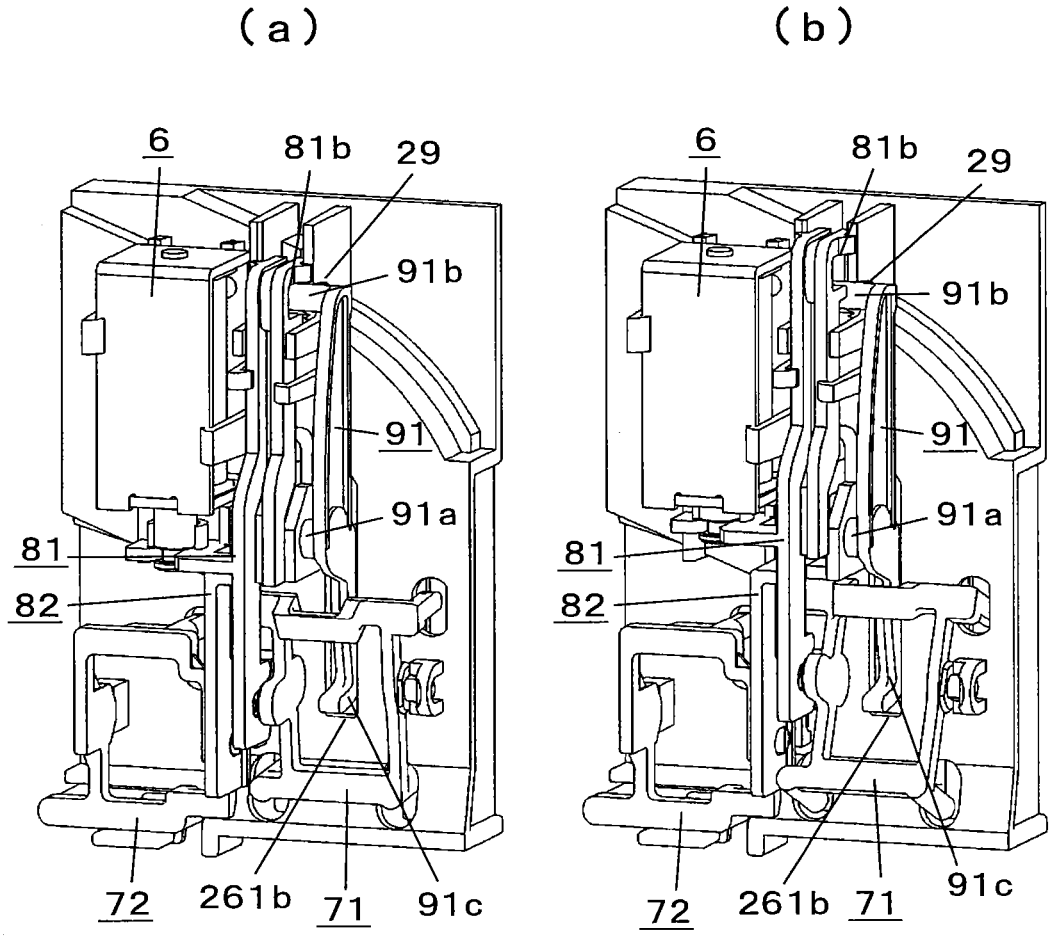
FIG. 5 is a diagram illustrating the temporary coin-withholding mechanism of the coin processing device according to the embodiment of the present invention, viewing from the backside of the coin processing apparatus, in the state in which there is a coin temporary withheld in the first coin sorting route, where (a) illustrates the initial state and (b) illustrates the state in which the solenoid is driven.

FIG. 4 is a cross-sectional view of the first coin sorting route 261 of the temporary coin withholding mechanism of the coin processing device according to the embodiment of the present invention in the state that there is a coin temporary withheld in the first coin sorting route 261, where (a) illustrates the initial state and (b) illustrates the state in which the solenoid 6 is driven. FIG. 5 is a diagram illustrating the temporary coin-withholding mechanism 5 of the coin processing device according to the embodiment of the present invention, viewing from the backside of the coin processing apparatus, in the state in which there is a coin temporary withheld in the first coin sorting route 261, where (a) illustrates the initial state and (b) illustrates the state in which the solenoid 6 is driven. In addition, FIG. 6 is a front view of the first coin sorting route 261 of the coin processing device according to the embodiment of the present invention in the state in which there is a coin temporary withheld in the first coin sorting route 261.

Figure 6:
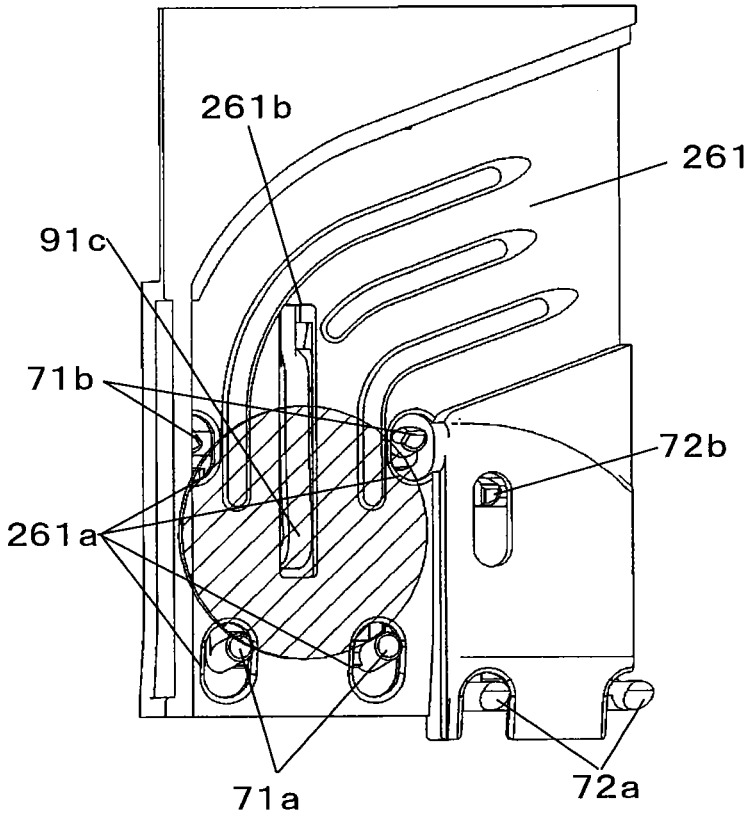
FIG. 6 is a front view of the first coin sorting route of the coin processing device according to the embodiment of the present invention in the state that a coin is temporary withheld in the first coin sorting route.

If a coin is temporary withheld in the first coin sorting route 261 by the lower protrusion 71*a* of the first coin withholding level 71, as shown in FIG. 4(*a*), FIG. 5(*a*), and FIG. 6, the coin detection protrusion 91*c* of the coin detection/link member 91 is retracted from the first coin sorting route 261. Then, the coin detection/link member 91 is rotated around its axis 91*a* as a pivot point, and the engagement protrusion 91*b* of the coin detection/link member 91 is detached from the U-shaped groove 81*b* of first link member 81 (the non-engagement position of the coin detection/link member). If the solenoid 6 is driven in this state, as illustrated in FIG. 4(*a*) and FIG. 5(*b*), the first link member 81 moves upward (the release position of the first link member) from the initial state (the withholding position of the first link member). Then, the first coin withholding lever 71 is rotated around the axes 71*c* as a pivot point to cause the lower protrusion 71*a* of the lever 71 to retract from the first coin sorting route 261 and the upper protrusion 71*b* thereof to protrude into the first coin sorting route 261 (the release position of the first coin withholding lever). Consequently, the coin temporary withheld is released and falls. At this time, the engagement between the U-shaped groove

81*b* of the first link member 81 and the engagement protrusion 91*b* of the coin detection/link member 91 is canceled. Thus, the second link member 82 remains in the initial state (the withholding position of the second link member). The second coin withholding lever 72 also remains in the initial state (the withholding position of the second coin withholding lever) and stays unmoved.

Furthermore, if the engagement between the U-shaped groove 81*b* of the first link member 81 and the engagement protrusion 91*b* of the coin detection/link member 91 is canceled, the engagement protrusion 91*b* of the coin detection/link member 91 detached from the U-shaped groove 81*b* of the first link member 81 is placed in a U-shaped groove 29 formed in the coin sorter 2. Therefore, even if any unintended force is applied from the outside, the engagement protrusion 91*b* of the coin detection/link member 91 is caught by the U-shaped groove 29 formed in the coin sorter 2 to prevent the coin detection/link member 91 from moving upward any more. Consequently, the second link member 82 engaged with the coin detection/link member 91 is also prevented from moving from the initial state (the withholding position of the second link member). In addition, the second coin withholding lever 72 engaged with the second link member 82 is also prevented from moving and remains in the initial state (the withholding position of the second coin withholding lever).

Figure 7:
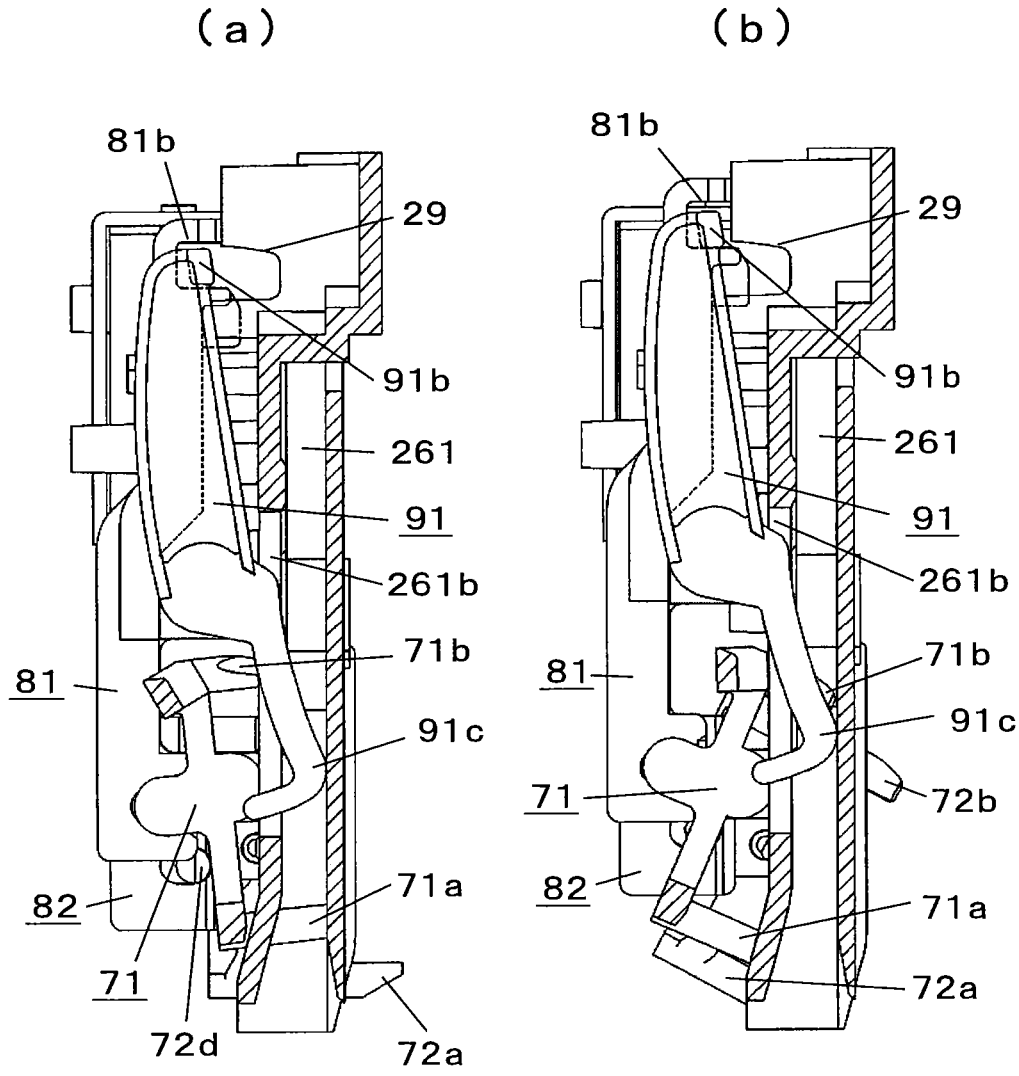
FIG. 7 is a cross-sectional diagram of the first coin sorting route of the temporary coin-withholding mechanism of the coin processing device according to the embodiment of the present invention in the state that there is no coin temporary withheld in the first coin sorting route, where (a) illustrates the initial state and (b) illustrates that the state in which the solenoid is driven.
Figure 8:
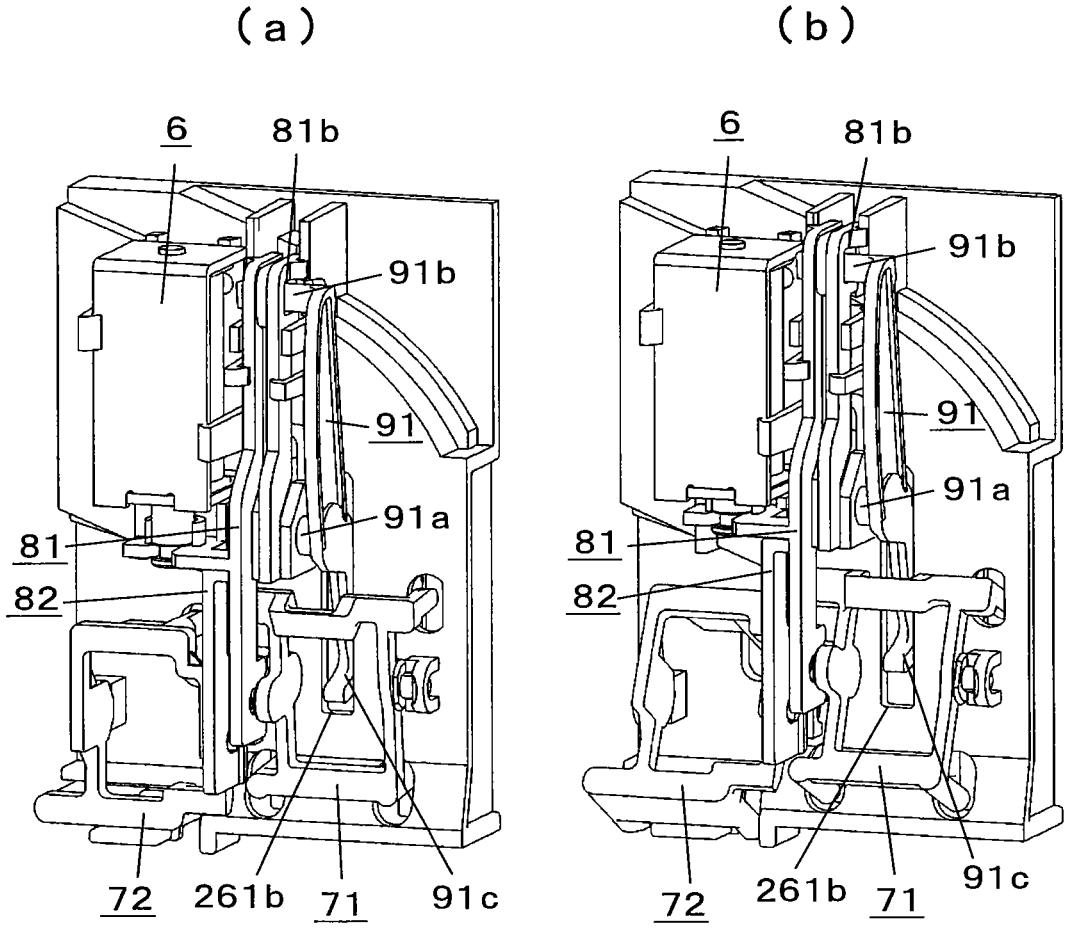
FIG. 8 is a diagram illustrating the temporary coin-withholding mechanism of the coin processing device according to the embodiment of the present invention, viewing from the backside of the coin processing device in the state that there is no coin temporary withheld in the first coin sorting route, where (a) illustrates the initial state and (b) illustrates that the state in which the solenoid is driven.

FIG. 7 is a cross-sectional diagram of the first coin sorting route of the temporary coin-withholding mechanism 5 of the coin processing device according to the embodiment of the present invention in the state that there is no coin temporary withheld in the first coin sorting route 261, where (a) illustrates the initial state and (b) illustrates that the state in which the solenoid 6 is driven. FIG. 8 is a diagram illustrating the temporary coin-withholding mechanism 5 of the coin processing device according to the embodiment of the present invention, viewing from the backside of the coin processing device, where (a) illustrates the initial state and (b) illustrates that the state in which the solenoid 6 is driven.

In the initial state, if there is no coin temporary withheld in the first coin sorting route 261, as illustrated in FIG. 7(*a*) and FIG. 8(*a*) the coin detection protrusion 91*c* of the coin detection/link member 91 protrudes into the first coin sorting route 261. In addition, the engagement protrusion 91*b* of the coin detection/link member 91 is engaged with the U-shaped groove 81*b* of the first link member 81 (the engagement position of the coin detection/link member). If the solenoid 6 is driven in such a state, as illustrated in FIG. 7(*b*) and FIG. 8(*b*), the first link member 81 moves upward (the release position of the first link member) from the initial state (the withholding position of the first link member 9). Then, the first coin withholding lever 71 is rotated about the axes 71*c* as a pivot point. The lower protrusion 71*a* of the lever 71 is retracted from the first coin sorting route 261, and the upper protrusion 71*b* thereof protrudes into the first coin sorting route 261 (the release position of the first coin withholding lever). At this time, the coin detection/link member 91 moves upward from the initial state by being pulled by the first link member 81. Then, the second link member 82 to be engaged with the coin detection/link member 91 also moves upward (the release position of the second link member) from the initial state (the withholding position of the second link member). Therefore, the second coin withholding lever 72 is also rotated around the axes 72*c* as a pivot point. The lower protrusion 72*a* is retracted from the second coin sorting route 262, and the upper protrusion 72*b* protrudes into the second coin sorting route 262 (the release position of the second coin withholding lever). Consequently, if a coin is temporary withheld in the second coin sorting route 262 by the lower protrusion 72*a* of the second coin withholding lever 72, the coin temporary withheld is released and falls.

According to the coin processing device of the present embodiment, the single solenoid 6 can drive two coin withholding lever, the first coin withholding lever 71 and the second coin withholding lever 72. Therefore, the production cost can be reduced. In addition, such a coin processing device temporary withholds coins near the lower end portion of the coin sorting route, so that the number of coins temporary withheld can be kept as its even if the single solenoid is employed to drive two coin withholding lever. Furthermore, according to the coin processing device, any coin temporary withheld in the second coin storing route 262 is released after releasing all coins temporary withheld in the first coin sorting route 261. Therefore, different type coins are not released alternately, and the coin sorting lever on the downstream of the temporary coin-withholding mechanism can be easily controlled.

In the above description, one of the embodiments of the present invention has been described. However, the coin processing device of the present invention is not limited to such an embodiment.

The driving means is not limited to a solenoid. The driving means may be one having an operation part capable of employing a withholding-operation position and a driving-operation position. For example, a motor may be used as a driving means and assembled with a gear mechanism to transmit power to the first link member.

The coin withholding lever may be one capable of taking a withholding position for withholding a coin guided by the coin sorting route to a predetermined position and a release position for releasing the coin withheld.

The first link means may be one which is able to locate at each of a withholding position and a release position in response to power from the driving means and to switch the first coin withholding lever between the withholding position and the release position depending on the location. The second link means may be also one which is able to locate at each of a withholding position and a release position and to switch the second withholding lever between the withholding position and the release position depending on the location.

The coin detection/link member has a function of detecting whether a coin is temporary withheld in the first coin sorting route, and, in response to the result of the detection, it can take either its engagement position for engagement with the first link member and the second link member or its non-engagement position for canceling the engagement with at least one of the first link member and the second link member. The coin detection/link member may be configured as follows: If the retention is not detected, the coin detection/link member takes its engagement position to allow the second link member to take its withholding position when the first link member is in its withholding position. If the first link member shifts to the release position, the second link member is also allowed to shift to the release position. If the retention is detected, the coin detection/link member takes its non-engagement position to allow the second link member to take its withholding position regardless of the position of the first link member. In the aforementioned embodiment, for example, the coin detection/link member is configured to rotatably engage with the second link member and detachably engage with the first link member. Alternatively, the coin detection/link member of the present invention may be configured to rotatably engage with the first link member and detachably engage with the second member. In the aforementioned embodiment, the coin detection/link member is configured to rotatably engage with the second link member. Alternatively, the coin detection/link member may be configured to allow the second link member and the coin detection protrusion to slidably engage with each other in the retracting direction and to allow the coin detection/link member to slide to cancel the engagement of the coin detection/link member with the first link member.

Figure 9:
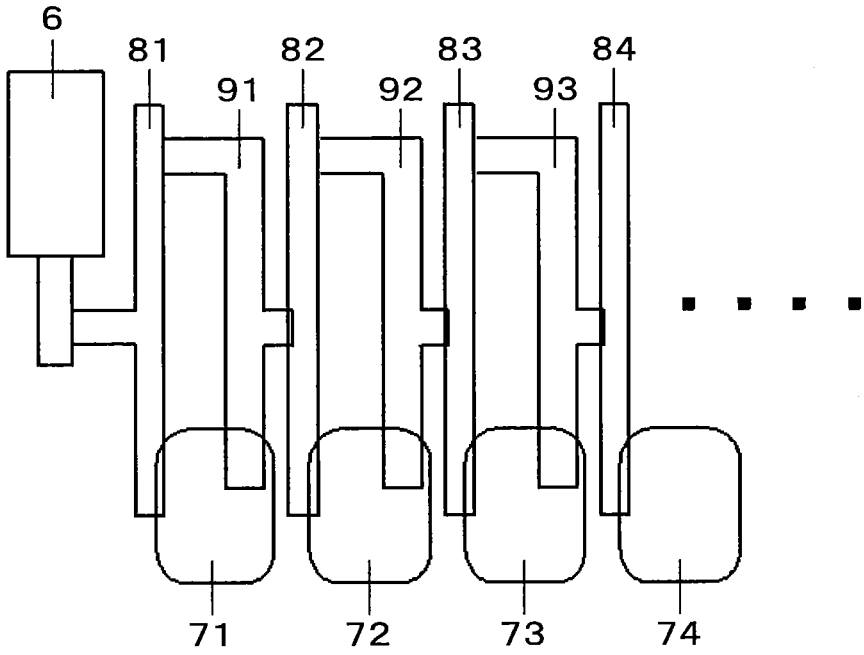
FIG. 9 is a schematic diagram illustrating the temporary coin-withholding mechanism installed in the coin processing device of the present invention.
Figure 10:
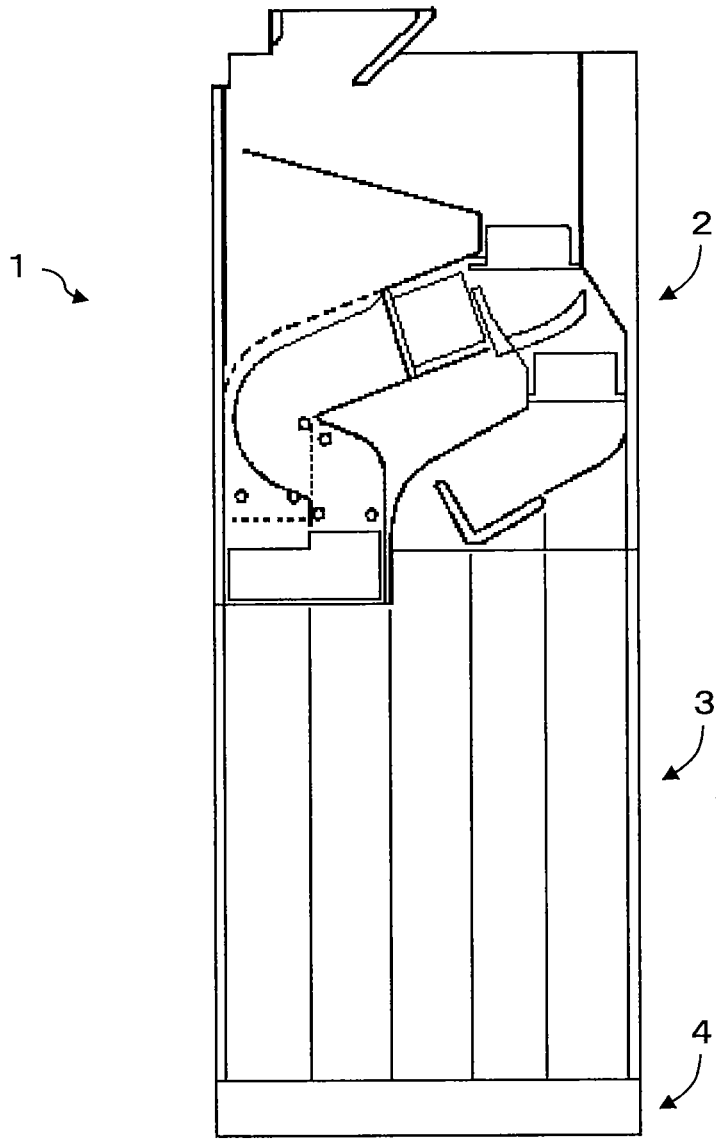
FIG. 10 is a schematic diagram that illustrating the coin processing device.

FIG. 9 is a schematic diagram illustrating the temporary coin-withholding mechanism installed in the coin processing device of the present invention. The coin processing device of the aforementioned embodiment has two coin withholding lever. However, the coin processing device of the present invention is not limited to one having two coin withholding levers. It may include three or more coin withholding lever to temporary withhold three or more different types of coins. As is found from FIG. 9, the temporary coin-withholding mechanism installed in the coin processing device can be easily provided with three or more coin withholding levers by addition of the respective pairs of coin withholding levers, link members, and coin detection/link member. FIG. 9 illustrates a temporary coin-withholding mechanism for driving four coin withholding levers 71 to 74 using a single driving means 6. It is configured such that one with two coin withholding levers is additionally provided with a second coin detection/link member 92, a third link member 83, a third coin-withholding lever 73, a fourth link member 84, and a fourth coin withholding lever 74.

Therefore, the temporary coin-withholding mechanism installed in the coin processing device of the present invention can easily drive three or more coin withholding lever using a single driving means.

REFERENCE SIGNS LIST

1 Coin processing device
2 Coin sorter
21 Insertion opening
22 Coin discrimination route
23 Coin determination means
24 Genuine/false coin distributing lever
25 Denomination distributing lever
261 First coin sorting route (A-type coin sorting route)
261 Hole (through which a lower protrusion 71*a* and an upper protrusion 71*b* of a first coin withholding lever 71 protrude and retract)
261*b* Hole (through which a coin detection protrusion 91*c* of a coin detection/link member 91 protrudes and retracts)
262 Second coin sorting route (C-type coin sorting route)
281 Coin sorting lever
282 Coin sorting lever
29 U-shaped groove
3 Coin storage unit
4 Coin payout unit
5 Temporary coin-withholding mechanism
6 Solenoid
6*a* Plunger of solenoid
71 First coin withholding lever
71*a* Lower protrusion
71*b* Upper protrusion
71*c* Axis
71*d* Passive protrusion
72 Second coin withholding lever
72*a* Lower protrusion
72*b* Upper protrusion
72*c* Axis
72*d* Passive protrusion
81 First link member
81*a* Hole (which engages with a passive protrusion 71*d* of a first coin withholding lever 71)
81*b* U-shaped groove
81*c* Connection part
82 Second link member
82*a* Hole (which engages with a passive protrusion 72*d* of a second coin withholding lever 72)
82*b* Hole (which engages with an axis of a coin detection/link member 91)
91 Coin detection/link member
91*a* Axis
91*b* Engagement protrusion
91*c* Coin detection protrusion
91*d* Spring

The invention claimed is:

1. A coin processing device, comprising a temporary coin-withholding mechanism, wherein the mechanism includes:

a single driving means;

a first coin withholding lever capable of taking a withholding position for withholding a first coin guided by a first coin sorting route at a predetermined position and a release position for releasing the first coin;

a second coin withholding lever capable of taking a withholding position for withholding a second coin guided by a second coin sorting route at a predetermined position and a release position for releasing the second coin; and a link means having a function of detecting whether the first coin is withheld in the first coin sorting route, the link means being configured that, when the retention is detected, the link means shifts the first coin withholding lever from the withholding position to the release position to make the driving means drive only the first coin withholding lever without driving the second coin withholding lever, and when the retention is not detected, the link means shifts the second coin withholding lever from the withholding position to the release position to make the driving means drive the second withholding lever.

2. A coin processing device, comprising a temporary coin-withholding mechanism, wherein the mechanism includes:

a single driving means having an operation part and capable of switching the operation part between a withholding-operation position and a driving-operation position;

a first coin withholding lever capable of taking a withholding position for withholding a first coin guided by a first coin sorting route at a predetermined position and a release position for releasing the first coin;

a second coin withholding lever capable of taking a withholding position for withholding a second coin guided by a second coin sorting route at a predetermined position and a release position for releasing the second coin;

a first link member driven by the operation part of the driving means, where the first link member takes a withholding position when the operation part takes the withholding-operation position, and takes a release position when the operation part takes the driving-operation position;

a second link member capable of taking a withholding position and a release position;

a coin detection/link member having a function of detecting whether the first coin is withheld in the first coin sorting route, and capable of taking, in response to a result of the detection, an engagement position for engagement with the first link member and the second link member and a non-engagement position at which the engagement with at least one of the first link member and the second link member is canceled, the coin detection/link member being configured that, when the retention is not detected, the coin detection/link member takes the engagement position; when the first link member takes the withholding position, the coin detection/link member makes the second link member take the withholding position, and when the first link member is switched to the release position, the coin detection/link member makes the second link member take the release position; and, when the retention is detected, the coin detection/link member takes the non-engagement position to make the second link take the withholding position regardless of the position of the first link member, wherein the first coin withholding layer is engaged with the first link member, takes the withholding position when the first link member is located at the withholding position, and is switched to the release position by the first link member when the first link member is switched to the release position, and the second coin withholding lever is engaged with the second link member, takes the withholding position when the second link member is located at the withholding position, and is switched to the release position by the second link member when the second link member is switched to the release position.

3. The coin processing device according to claim 2, wherein the coin detection/link member includes:

an engagement protrusion rotatably engaging with the second link member and detachably engaging with a U-shaped groove formed in the first link member; and a coin detection protrusion to be retracted from the first coin sorting route by the first coin when the first coin is withheld in the first coin sorting route and to be protruded into the first coin sorting route when the first coin is not withheld in the first coin sorting route, the coin detection/link member being configured that, when the first coin is not withheld in the first coin sorting route, the engagement protrusion of the coin detection/link member is engaged with the U-shaped groove of the first link member, when the first coin is withheld in the first coin sorting route, the coin detection protrusion is retracted from the first coin sorting route to allow the coin detection/link member to rotate about the first link member, and the rotation of the coin detection/link member cancels the engagement of the engagement protrusion of the coin detection/link member with the u-shaped groove of the first link member.

* * * * *